US006379857B1

(12) United States Patent
Taguchi et al.

(10) Patent No.: US 6,379,857 B1
(45) Date of Patent: Apr. 30, 2002

(54) METHOD FOR FORMING COLOR IMAGE

(75) Inventors: Tetsuya Taguchi; Akihiro Iizuka; Koutarou Yoshihara; Susumu Yoshino; Haruhide Ishida; Rieko Kataoka, all of Minamiashigara (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 09/707,932

(22) Filed: Nov. 8, 2000

(30) Foreign Application Priority Data

Jan. 14, 2000 (JP) ..... 2000-006957

(51) Int. Cl.[7] ..... G03G 13/14
(52) U.S. Cl. ..... 430/126; 430/111.41; 399/308
(58) Field of Search ..... 430/126, 111.41; 399/308

(56) References Cited

FOREIGN PATENT DOCUMENTS

JP 5-40309 B2 6/1993
JP 6-29992 B2 4/1994
JP 7-31422 B2 4/1995
JP 7-120086 B2 12/1995

*Primary Examiner*—Mark Chapman
(74) *Attorney, Agent, or Firm*—Oliff & Berridge, PLC

(57) ABSTRACT

Provided is a method for image formation capable of stably outputting high-quality images with no image density unevenness for a long period of time, in which the images formed are free from image defects of edge deletions and other deletions therein and which ensures good and uniform developability everywhere in the latent image region to be developed with preventing the latent image support used from being degraded. The method includes a step of forming a latent image on a latent image support, a step of developing the latent image on the latent image support with a two-component developer on a developer support disposed to face the latent image support, and a step of transferring the thus-developed toner image onto a transfer medium, wherein the developer support is a cylindrical sleeve having a diameter of at most 20 mm or the latent image support is a cylindrical sleeve having a diameter of at most 40 mm, and the resistance of the two-component developer is at least $10^{13}\Omega$ in an electric field of 2 V/$\mu$m.

20 Claims, No Drawings

METHOD FOR FORMING COLOR IMAGE

BACKGROUND OF THE INVENTION

1. Field of the Invention

The present invention relates to a method for forming color images according to a process of electrophotography or electrostatic recording. More precisely, the invention relates to such a method for forming a color image with a two-component developer including a color toner and a carrier, for printers, duplicators, facsimiles and others for printing out color images, especially full-color images.

2. Description of the Related Art

Heretofore, the main stream of electrophotography to produce visible images by developing latent images having been formed on a latent image holding member includes a method of unary development where a latent image formed on a holding member is brought into contact with a thin toner layer formed on a developer holding member so that it is developed with the toner, and a method of binary development where a developer that contains a toner and a magnetic carrier is held on a developer holding member having a magnet therein to provide a magnetic brush, and a latent image formed on a holding member is brought into contact with the magnetic brush so that it is developed with the toner.

Single component development will be better than two-component development in that the size and the weight of the apparatus for it could be readily reduced, but it involves some problems in that the amount of the toner to be applied to and held on the developer holding member is often difficult to stabilize and the electrostatic charge of the toner is difficult to control as compared with that of the two-component developer for two-component development. On the other hand, in two-component development, the amount of the two-component developer to be applied to and held on the developer holding member can be well stabilized as the holding member is assisted by the magnetic force of the magnet which it has therein. In this, in addition, the toner and the carrier to be used are stirred so that the toner is electrostatically charged through friction. Accordingly, in such two-component development, the frictional electrostatic charge of the toner could be well controlled to a relatively high degree by appropriately selecting the characteristics of the toner, the stirring condition and the toner concentration in the developer, and therefore the electrostatically charged toner that will often fluctuate depending on the ambient environment and the processing time could be readily stabilized to ensure high reliability to give high-quality images.

For forming color images, the degree of development must be accurately controlled to realize the intended color formation, for which, therefore, two-component developers are much used as it is easy to well control the degree of electrification of the toner therein.

In two-component development, the developer resistance has a significant influence on the quality of the images formed. In a process of such two-component development, in general, the peripheral velocity of the developer holding member is kept higher than that of the latent image holding member in order that a sufficient amount of the developer could be supplied to the development zone. In this, however, if the developer resistance is high, image defects will be often inevitable owing to the velocity difference between the developer holding member and the latent image holding member. In such a case where the peripheral speed of the developer holding member differs from that of the latent image holding member, the developer holding member will be influenced by the electric field of the other latent image region that differs from the region of the latent image to be actually developed therewith, before it reaches the region of the latent image holding member which is kept in contact with a magnetic brush with which the latent image in the region is actually developed (the region is hereinafter referred to as a development nip region). If so, the electrostatic charge of the developer will partly vary, and the image developed in such a condition could not faithfully reproduce the latent image. As a result, in a region where the latent image structure varies to a great extent, significant image defects will be inevitable in the developed image area. For example, the density of the trail edge of the solid image adjacent to a non-image area will be thinned; or in a region where a half-tone image and a solid image exist at random, the lead edge of the solid image and the trail edge of the half-tone image will be lost (the image defects are hereinafter referred to as "edge deletions").

The development fluctuation in color images results in color drift therein, and therefore the requirement for preventing image defects such as edge deletions in solid images and half-tone images is greater than that for preventing them in monochromatic images.

For preventing such image defects, for example, one technique is proposed in Japanese Patent Publication No. 31422/1995, which includes reducing the carrier resistance for preventing edge deletions in solid images. Reducing the carrier resistance as proposed could be effective for preventing edge deletions in solid images, but is often still problematic in that a wax-containing small-particle toner to improve the fixing properties and a small-particle carrier that constitute a developer will both adhere to a latent image-holding member in the step of developing the latent image with the developer. If so, the developed image on the support could not form a suitable nip in and around the carrier-containing region therein when it is transferred onto a recording medium or onto an intermediate transfer medium, since the particle size of the toner greatly differs from that of the carrier. As a result, the carrier-containing region in the developed image Will result in transfer failure, thereby causing edge deletions in solid images. Transfer failure in image formation causes deletions in monochromatic images, or causes color drifts (hereinafter referred to as "deletions") in multi-developed and multi-transferred color images, and these image defects are often serious in image formation.

SUMMARY OF THE INVENTION

The present invention is to solve the problems as above in the related art and to attain the aims to be mentioned below. Specifically, the invention is to provide a method for image formation capable of stably outputting high-quality images with no image density unevenness for a long period of time, in which the images formed are free from image defects of so-called deletions or edge deletions therein and which ensures good and uniform developability everywhere in the latent image region to be developed while preventing the latent image holding member used from being degraded.

To attain the aims as above, the invention provides the following:

<1> A method for forming a color image including a step of forming a latent image on a latent image holding member, a step of developing the latent image on the latent image holding member with a two-component developer on a developer holding member disposed to face the latent image holding member, and a step of transferring the thus-developed toner image onto a transfer medium, wherein the developer holding member is a cylindrical sleeve having a diameter of at most 20 mm, the two-component developer contains a carrier and a toner, and the developer resistance is at least $10^{13}\Omega$ in an electric field of 2 V/$\mu$m.

<2> A method for forming a color image including a step of forming a latent image on a latent image holding member, a step of developing the latent image on the latent image holding member with a two-component developer on a developer holding member disposed to face the latent image holding member, and a step of transferring the thus-developed toner image onto a transfer medium, wherein the latent image holding member is a cylindrical sleeve having a diameter of at most 40 mm, and the resistance of the two-component developer is at least $10^{13}\Omega$ in an electric field of 2 V/$\mu$m.

In the image-forming method of the invention, the resistance of the two-component developer to be used is defined on a high level to be at least $10^{13}\Omega$ in an electric field of 2 V/$\mu$m, whereby the images formed are prevented from having deletions therein. In the method, in addition, the diameter of the developer holding member is defined small to be at most 20 mm or the diameter of the latent image holding member is defined also small to be at most 40 mm, whereby the images formed are prevented from having edge deletions therein. Moreover, in the method, the latent image holding member used is prevented from being degraded owing to the specific limitation of the developer resistance which is combined with the specific limitation of the diameter of the latent image holding member or the developer holding member in the manner as above. Accordingly, the method ensures good and uniform developability everywhere in the latent image region to be developed and enables long-term stable outputting of high-quality images with no image density unevenness.

DESCRIPTION OF THE PREFERRED EMBODIMENTS

According to the image-forming method of the invention, a two-component developer is continuously fed onto a developer holding member which is disposed to face a latent image holding member, thereby forming thereon a thin layer of the two-component developer, and the thin developer layer is brought into contact with the latent image holding member to thereby develop a latent image written on the holding member into a toner image. This step in the method is a development step.

In the image-forming method of the invention, the resistance of the developer to be used is defined on a high level, as will be described in detail hereinunder, whereby the images formed are prevented from having deletions therein; and, in addition, the diameter of the developer holding member or that of the latent image holding member is defined small, as will be also described in detail hereinunder, whereby the images formed are prevented from having edge deletions therein. Moreover, in the method, the latent image holding member used is prevented from being degraded owing to the specific limitation of the developer resistance which is combined with the specific limitation of the diameter of the latent image holding member or that of the developer holding member in the manner to be described in detail hereinunder. This will be because of the following reasons: In general, in the step of developing a latent image with a developer, the distance between the latent image holding member and the developer holding member has an important meaning. In case where the distance between the latent image holding member and the developer holding member is too broad, the developability of the latent image with the developer will be poor. On the other hand, in case where the distance is narrow, the developability will be good. However, if the distance is too narrow, the area of the thin developer film (magnetic brush layer) to be kept in contact with the latent image holding member will be large whereby the latent image holding member will be much abraded or scratched by the thin developer film (magnetic brush layer). In order to reduce the distance between the latent image holding member and the developer holding member while the contact area between the thin developer film (magnetic brush layer) and the latent image holding member is kept small, reducing the developer holding member diameter or the latent image holding member diameter will be effective. However, reducing the developer holding member diameter or the latent image holding member diameter to that effect will result in the reduction in the density of the thin developer film (magnetic brush layer) on the developer holding member, whereby the current to the thin developer film (magnetic brush layer) on each developer holding member shall be large. As a result, a current leak from the developer holding member to the latent image holding member will be often inevitable in that condition. Such a current leak from the developer holding member to the latent image holding member, if any, will degrade the surface of the latent image holding member whereby the thus-degraded latent image holding member will fail to form thereon an intended electrostatic latent image. After all, this will result in image defects of color drifts or deletions in the images formed. To evade the problem, the developer resistance is defined high and the developer holding member diameter or the latent image holding member diameter is defined small, as will be described in detail hereinunder, whereby the latent image holding member is prevented from being worn or scratched, and, in addition, a current leak from the developer holding member to the latent image holding member is prevented to protect the surface of the latent image holding member from being degraded. Accordingly, the latent image holding member is prevented from being degraded.

Developer Holding Member

The developer holding member for use in the invention is a cylindrical development sleeve having a diameter of at most 20 mm. Having such a small diameter, the developer holding member sleeve is effective for preventing edge deletions in the images formed. This will be because of the following reasons: One reason for edge deletions in images is that the thin developer film (magnetic brush layer) before the development nip is influenced by the electric field of the latent image on the latent image holding member, and its electrostatic charge is thereby changed. To evade the problem, the diameter of the developer holding member is reduced. The curvature of the developer holding member having such a small diameter is large, and the distance between the surface of the latent image holding member and the thin developer film (magnetic brush layer) before the development nip is thereby enlarged. As a result, the thin developer film (magnetic brush layer) before the development nip is hardly influenced by the electric field of the latent image on the latent image holding member, and can safely reach the development region while being electrostatically stabilized. Accordingly, stable development is possible in that condition, and the images thus formed will be free from image defects of edge deletions therein.

Preferably, the developer holding member is a cylindrical sleeve having a diameter of from 10 mm to 19 mm for ensuring good development efficiency and for preventing toner fusion. If, however, its diameter is too small, the developer holding member could hardly have satisfactory magnetic force.

The developer holding member sleeve has a magnetic field-generating unit such as a magnet or the like, inside it. Preferably, the magnetic force of the magnet is at least 0.1 T (1000 gausses), more preferably at least 0.12 T (1200 gausses). If the magnetic force is too small, the images formed will have deletions therein, and, in addition, the force of the developer holding member to carry and convey a developer will be low whereby the magnetic brush layer formed on the holding member will be uneven and the developer being carried and conveyed thereon will drop off.

The developer holding member sleeve may be made from any known material. For example, it may be made of a metal such as aluminium, stainless steel, nickel or the like; or such a metal coated with carbon, resin elastomer or the like; or a non-foamed, foamed or sponge-wise processed elastic material of natural rubber, silicone rubber, urethane rubber, butadiene rubber, chloroprene rubber or the like; or such an elastic material coated with carbon, resin elastomer or the like.

Preferably, the surface of the developer holding member sleeve is roughened so as to improve its ability to carry and convey a developer thereon. For roughening the surface of the sleeve, employable is any of a sand-blasting method, a glass bead-blasting method, a filing method, a method of coating the sleeve with a resin followed by partly etching it or the like, but these methods are not limitative.

In case where the latent image holding member for use herein (this will be described in detail hereinunder) is a cylindrical sleeve having a diameter of not larger than 40 mm, the developer holding member may not be such a sleeve having a diameter of at most 20 mm. In case where the latent image holding member is a cylindrical sleeve having a diameter of not larger than 40 mm, it is desirable that the diameter of the developer holding member falls between 10 mm and 35 mm, more preferably between 15 mm and 27 mm for ensuring good development efficiency and for preventing toner fusion.

Latent Image Holding Member

The latent image holding member for use in the invention is a cylindrical sleeve having a diameter of at most 40 mm. Having such a small diameter, the latent image holding member sleeve is effective for preventing edge deletions in the images formed. This will be because of the same reasons as those mentioned hereinabove for the reduction in the diameter of the developer holding member.

Preferably, the latent image holding member is a cylindrical sleeve having a diameter of from 18 to 40 mm for stabilizing the quality of the images formed. If its diameter is too small, the frequency of repeatedly using it will increase whereby the sleeve being such repeatedly used will be much worn or scratched and the image quality will be soon degraded.

The latent image holding member may be any known one, including, for example, organic photoreceptors, amorphous silicon photoreceptors, selenium photoreceptors, etc. The organic photoreceptor for the latent image holding member may have a single-layered or multi-layered structure. The single layer of the single-layered layered latent image holding member may be a color-sensitized photosensitive ZnO or ZdS layer, or a photosensitive layer containing a charge-generating material dispersed in a charge-transporting material. The multi-layered latent image holding member may have a charge-generating layer and a charge-transporting layer formed separately for their functions.

The charge-generating layer is formed from a charge-generating material optionally dispersed in a binder resin. The charge-generating material includes, for example, color-sensitized selenium and selenium alloys; color-sensitized, inorganic photoconductive materials of, for example, CdS, CdSe, CdSSe, ZnO, ZnS, etc.; metal-containing or metal-free phthalocyanine pigments; azo pigments such as bisazo pigments, trisazo pigments, etc.; squarylium compounds; azulenium compounds; perylene pigments; indigo pigments; quinacridone pigments; polycyclic quinone pigments; cyanine dyes; xanthene dyes; charge transfer complexes of poly-N-vinylcarbazole with trinitrofluorenone, etc.; eutectic complexes of pyrylium base dye with polycarbonate resin, etc. Any known binder resin is usable for the charge-generating layer, including, for example, polycarbonates, polystyrenes, polyesters, polyvinyl butyrals, methacrylate polymers and copolymers, vinyl acetate polymers and copolymers, cellulose esters and ethers, polybutadienes, polyurethanes, epoxy resins, etc.

The charge-transporting layer contains, as the essential ingredient, a charge-transporting material. The charge-transporting material is not specifically defined, so far as it is transparent for visible rays and has the ability to transport charges. Concretely, it includes imidazole, pyrazoline, thiazole, oxadiazole, oxazole, hydrazone, ketazine, azine, carbazole, polyvinylcarbazole, and their derivatives, as well as triphenylamine derivatives, stilbene derivatives, benzidine derivatives, etc. If desired, it may be combined with a binder resin of, for example, polycarbonates, polyacrylates, polyesters, polystyrenes, styrene-acrylonitrile copolymers, polysulfones, polymethyl methacrylates, etc.

In case where the developer holding member mentioned above is a cylindrical sleeve having a diameter of not larger than 20 mm, the latent image holding member may not be such a sleeve having a diameter of at most 40 mm. In that case, the latent image holding member may be any of cylindrical or sheet holding members.

Two-Component Developer

The two-component developer for use herein has a resistance of at least $10^{13}\Omega$ in an electric field of 2 V/$\mu$m. The developer having such a high resistance of $10^{13}\Omega$ in an electric field of 2 V/$\mu$m prevents the carrier therein from adhering to the developed image area to cause deletions in the image area. The developer resistance referred to herein is in terms of the unit in the lengthwise direction of the developer holding member. Concretely, it is the resistance of the developer in the actual development nip, and is obtained as follows: A thin layer (that is, a magnetic brush layer) of the two-component developer is formed on the developer holding member for use herein, an aluminium pipe of which the size is the same as that of the latent image holding member for use herein is disposed to face the developer holding member so that the two may form the actual development nip therebetween, and a direct current is applied to the developer holding member and the aluminium pipe. The resistance derived from the current value is divided by the length of the developer nip, and this indicates the developer resistance. The electric field is obtained by dividing the voltage applied to the developer holding member and the aluminium pipe by the distance between the two, the holding member and the pipe.

Preferably, the resistance of the two-component developer falls between $10^{13}$and $10^{16}\Omega$ in an electric field of 2 V/$\mu$m for ensuring good image quality and good developability. If the developer resistance is too high, the images formed will have significant edge deletions therein.

Preferably, the two-component developer contains a color toner (this will be hereinafter simply referred to as "toner"

only) and a carrier. It is desirable that the toner content of the two-component developer falls between 3 and 16% by weight and the toner coverage of the carrier falls between 13 and 70% for ensuring good development.

Preferably, the toner contains at least a binder resin, fine inorganic particles, wax and a colorant. The reason why the toner preferably contains such wax and fine inorganic particles is described below.

For forming color images, especially oilless color images, a lubricant for promoting good fixation is generally added to toner, or a binder resin having a high melt viscosity is added thereto so that the toner being fixed in melt hardly moves to the fixation member. However, if such a binder resin having a high melt viscosity is added to the toner, the surface of the fixed image could not be smooth. If so, the image will be poorly glossy and will be dull, and its quality will be not high. For monochromatic images, on the other hand, glare letter images are disliked. For these, therefore, a binder resin having a high melt viscosity is added to toner.

In color image formation, however, good coloration of the images formed is of critical importance to smooth the surface of the fixed image. For this, therefore, a binder resin having a low melt viscosity is added to color toners in order that the toners of different colors could well dissolve and mix together to give vivid and clear secondary colors. The intermolecular binding force of such a binder resin having a low melt viscosity is low when it is in melt. Therefore, one problem with it is that the binder resin of the type easily moves from the recording medium on which images are formed to the fixation member used for image formation, and further moves from the fixation member to the other region of the recording medium to thereby cause significant image drift. Adding a low-melting-point wax to toners will be effective for preventing the problem of such image drift. Recently, however, it has been found that wax of the type often detracts from the storability, the fluidity and the productivity of the toners containing it.

In general, toners, after a fluidity improver is added thereto, will be stored for a long period of time while on the market and in factories where they are produced. Even before a fluidity improver is added thereto, toners will be stored for a long period of time in factories. In toners containing a low-melting-point wax added thereto, some part of the wax is exposed out on their surfaces or some other part thereof inside the toners will bleed out thereon under heat or pressure. The wax thus exposed out on the toner surfaces is highly adhesive and will aggregate the toner particles. A fluidity improver, if added to toners, will be effective to prevent such toner aggregation in some degree, but its effect could not last long as it is often embedded inside the toner particles or is often peeled off from the toner particle surfaces. While stored in factories, toners could be prevented from aggregating together by suitable environmental control or shelf life control. On the market, however, controlling toners for preventing them from aggregating together is an important problem. Increasing the amount of the fluidity improver to be added thereto will be effective for improving the storage stability of toners in early stages. However, as so mentioned hereinabove, the fluidity improver added to toners is often embedded inside the toners or peeled off from them, and its effect could not last long. Too much amount of the fluidity improver, if added to toners, will transfer onto latent image holding members or even onto the surfaces of carrier particles, thereby causing image defects or ending in electrostatic charging failure.

On the other hand, the productivity of toners will be lowered for the following reasons: In an ordinary kneading and milling method for producing toners, plural starting materials are mixed while being heated or while being under high shear force applied thereto to heat them by friction. In this stage, if the shear force applied thereto is not satisfactorily high, the materials kneaded could not form a uniform mixture. In particular, in case where a low-melting-point wax or a low-melt-viscosity binder resin is added thereto, the starting materials could not be well kneaded since satisfactory shear force could not be applied thereto owing to the lubricity of the wax or the melt of the binder resin, and the wax will too much disperse in the resulting mixture or the wax and the binder resin could not uniformly mix therein.

To solve the problem, fine inorganic particles are added to, along with wax, and mixed with the starting materials. The fine inorganic particles added thereto will act as a filler while the binder resin in the starting materials is melted, thereby facilitating the shear force application to the starting materials being kneaded, and facilitating the wax dispersion in the resulting mixture to be toner. In case where the wax in the toner thus prepared is finely dispersed, the amount of the wax to be exposed outside the toner particles will decrease, and the storability and the fluidity of the toner will be improved. In addition, a part of the fine inorganic particles will be exposed outside the toner particle surfaces, and, in that condition, they could act for the fluidity improver fly adhered onto the toner particles without peeling off from them. Fine inorganic particles added to toners thus act to improve the storability, the fluidity and the productivity of the toners containing them, and further act to prevent image defects. They exist on the toner particle surfaces while being exposed outside thereon and therefore preventing wax from being exposed outside on the toner particle surfaces. Accordingly, the adhesiveness of the toners containing them is reduced. As a result, in the process of developing latent images with them, the toners do not adhere to carrier particles and therefore the carrier particles are prevented from being transferred onto latent images along with the toner particles to cause deletions in the developed images.

For the reasons mentioned above, it is desirable that the toners for use in the invention contain at least a binder resin, fine inorganic particles, wax and a colorant.

The binder resin includes, for example, homopolymers or copolymers of styrenes such as styrene, chlorostyrene, etc.; monoolefins such as ethylene, propylene, butylene, isoprene, etc.; vinyl esters such as vinyl acetate, vinyl propionate, vinyl benzoate, vinyl acetate, etc.; α-methylene-aliphatic monocarboxylates such as methyl acrylate, ethyl acrylate, butyl acrylate, dodecyl acrylate, octyl acrylate, phenyl acrylate, methyl methacrylate, ethyl methacrylate, butyl methacrylate, dodecyl methacrylate, etc.; vinyl ethers such as vinyl methyl ether, vinyl ethyl ether, vinyl butyl ether, etc.; vinyl ketones such as vinyl methyl ketone, vinyl hexyl ketone, vinyl isopropenyl ketone, etc. Typical examples of such binder resins are polystyrenes, styrene-alkyl acrylate copolymers, styrene-alkyl methacrylate copolymers, styrene-acrylonitrile copolymers, styrene-butadiene copolymers, styrene-maleic anhydride copolymers, polyethylenes, polypropylenes, and also polyester resins, polyurethane resins, epoxy resins, silicone resins, polyamides, modified rosins, paraffin waxes, etc. Of those, especially preferred are polyesters.

For the polyester resins, preferred are those produced through polycondensation of a polyol component and a polycarboxylic acid component (for example, linear polyester resins including polycondensates from essential monomer components, bisphenol A and a polyaromatic carboxylic acid). The polyol component includes, for example, ethylene glycol, propylene glycol, 1,3-butanediol, 1,4-butanediol, 2,3-butanediol, diethylene glycol, triethylene glycol, 1,5-butanediol, 1,6-hexanediol, neopentyl glycol, cyclohexanedimethanol, hydrogenated bisphenol A, bisphenol A-ethylene oxide adducts, bisphenol A-propylene oxide adducts, etc. The carboxylic acid component includes, for example, maleic acid, fumaric acid, phthalic acid, isophthalic acid, terephthalic acid, succinic acid, dodecenylsuccinic acid, trimellitic acid, pyromellitic acid, cyclohexane-tricarboxylic acid, 2,5,7-naphthalene-tricarboxylic acid, 1,2,4-naphthalene-tricarboxylic acid, 1,2,5-hexane-tricarboxylic acid, 1,3-dicarboxyl-2-methylenecarboxypropane-tetramethylenecarboxylic acid, and their hydrides.

For the polyester resins, especially preferred are those having a softening point of from 90 to 150° C., a glass transition point of from 55 to 75° C., a number-average molecular weight of from 2000 to 6000, a weight-average molecular weight of from 8000 to 150000, an acid value of from 5 to 30, and a hydroxyl value of from 5 to 40.

For the polyester resins, also preferred are those prepared from at least three constituent components of a compound of bisphenol modified at its both terminals with from 2 to 7 groups in total, a compound of bisphenol modified at its both terminals with from 2 to 7 propylene oxide groups in total, and glycerin, and having a number-average molecular weight of from 2500 to 4500, a weight-average molecular weight of from 7000 to 40000, a softening point of from 95 to 120° C., and a glass transition point of from 60 to 80° C., but not containing a chloroform-insoluble component.

The fine inorganic particles for use herein may be any of known inorganic compounds including, for example, silica, alumina, titania, etc., but these are not limitative. Of these, preferred are fine silica particles having a smaller refractive index than binder resins, as they ensure good OHP transparency. The fine silica particles may contain not only anhydrous silica but also aluminium silicate, sodium silicate, potassium silicate, etc., but are preferably so constituted that their refractive index is at most 1.5.

The fine inorganic particles may be subjected to surface treatment in various methods. Concretely, for example, preferred are fine inorganic particles having been subjected to surface treatment with any of silane coupling agents, titanium coupling agents, silicone oils, etc.

Preferably, the amount of the fine inorganic particles to be in the toner for use in the invention falls between 1 and 10 parts by weight, more preferably between 3 and 7 parts by weight, based on the binder resin to be therein. If their amount added is smaller than 1 part by weight, they could not satisfactorily exhibit their effect; but if larger than 10 parts by weight, they will have some negative influences on the toners in that the surface of the fixed images could not be smooth and therefore the color quality of the images will be poor, or in producing the toners, the starting materials for them could not be smoothly fed through feeders to cause feeding failure. One type or two or more different types of the fine inorganic particles may be used herein either singly or as combined.

The wax for use herein includes, for example, ester compounds, amide compounds, alcohols, fatty acids, ketones, hardened castor oils, vegetable waxes, animal waxes, mineral waxes, petrolactams, and their modified derivatives, etc. Also usable are paraffin wax and its derivatives, polyolefin wax and its derivatives, montan wax and its derivatives, microcrystalline wax and its derivatives, Fisher-Tropsch wax and its derivatives. The derivatives include oxides, polymers with vinyl monomers, and graft-modified derivatives.

Preferably, the wax for use herein has a melting point of from 80 to 120° C., and a kinematic melt viscosity of at most $3\times10^{-4}$ $m^2$/sec (300 cSt) at 120° C. More preferably, its kinematic melt viscosity at 120° C. falls between $1\times10^{-5}$ $m^2$/sec and $2\times10^{-4}$ $m^2$/sec (between 10 and 200 cSt). For better oilless fixation, it is especially desirable that the wax to be used has a melting point and a kinematic melt viscosity both falling within the preferred range as above. If the melting point of the wax used is lower than 80° C., the temperature at which the wax can change to the desired phase will be too low and the blocking resistance of the fixed images will be poor. If so, in addition, the image developability will worsen when the temperature inside duplicators has increased high. On the other hand, if the melting point of the wax used is higher than 120° C., the temperature at which the wax can change to the desired phase will be too high. Such will cause no problem for high-temperature fixation, which, however, is undesirable for energy saving. In case where the kinematic melt viscosity of the wax used is higher than $3\times10^{-4}$ $m^2$/sec (300 cSt), the wax will poorly bleed out of toners and the lubricity of the fixed images to peel off from the image holding member will be low.

Preferably, the endothermic transition point of the wax in its DSC curve to be obtained through differential scanning calorimetry is at least 40° C., more preferably at least 50° C. If the endothermic transition point of the wax used is lower than 40° C., the toners will aggregate in duplicators or in toner bottles. The endothermic transition point of wax depends on the low-molecular-weight components of the wax to be identified through molecular weight distribution analysis and also on the type and the amount of the polar groups constituting the structure of the components. In general, wax having been so modified that it has an increased molecular weight will have an increased melting point and an increased endothermic transition point, but such modification is against the low melting point and the low melt viscosity intrinsic to original wax. Therefore, a screening method of selectively removing only the low-molecular-weight components in the molecular weight distribution of wax will be effective for obtaining the wax having an increased endothermic transition point for use in the invention. For the method, for example, employable is molecular distillation, solvent fractionation, gas chromatographic fractionation or the like.

The amount of the wax to be in the toner for use herein preferably falls between 1 and 15% by weight, more preferably between 3 and 10% by weight of the toner. If the amount of the wax is smaller than 1% by weight, the fixation latitude (the fixation roll temperature range for good fixation with no toner offset) will be narrow; but if larger than 15% by weight, the excessive wax will separate from the toner to be free wax, and it will soil developer holding member. In addition, the free wax will lower the powdery flowability of the toner, or it will adhere to the surface of the latent image holding member on which latent images are formed, thereby interfering with accurate latent image formation. Moreover, the transparency of wax is generally lower than that of binder resins. Therefore, too much wax, if any, in the toner will lower the transparency of the images formed for OHP, and the images projected through OHP will be dark and dull.

Typical examples of the colorant to be in the toner for use in the invention are carbon black, nigrosine, aniline blue, chalcoyl blue, chrome yellow, ultramarine blue, DuPont oil red, quinoline yellow, methylene blue chloride, phthalocyanine blue, malachite green oxalate, lamp black, rose bengal, C.I. Pigment Red 48:1, C.I. Pigment Red 122, C.I. Pigment Red 57:1, C.I. Pigment Yellow 97, C.I. Pigment Yellow 12, C.I. Pigment Blue 15:1, C.I. Pigment Blue 15:3, etc.

The toner may contain at least one internal additive, static controller which is for controlling the static charge of the toner, in addition to the constituent components, binder resin, fine inorganic particles, wax and colorant. It may further contain a petroleum resin which is for ensuring the grindability and the thermal storability of the toner. The petroleum resin is produced from diolefins and monoolefins which are in the side-produced, cracked oil fractions in ethylene plants where ethylene and propylene are produced through petroleum steam cracking. In addition, for further improving the long-term storability, the fluidity, the developability and the transferability of the toner, the toner particles may be coated with inorganic powder and/or resin powder either singly or as combined. The inorganic powder includes, for example, powders of carbon black, silica, alumina, titania, zinc oxide, etc. The resin powder includes, for example, spherical powders of PMMA, nylon, melamine resin, benzoguanamine resin, fluororesin, etc.; and amorphous powders of polyvinylidene chloride, metal salts of fatty acids, etc. The amount of the inorganic powder and the resin powder preferably falls between 0.2 and 4% by weight, more preferably between 0.5 and 3% by weight each.

The toner may be produced in any known method. The production method includes various known methods of, for example, kneading combined with milling, suspension polymerization, emulsion polymerization combined with aggregation, drying in liquid, etc., but these are not limitative.

Preferably, the carrier for use in the invention is in the form of particles prepared by coating magnetic cores with a coating resin.

The magnetic core is typically a ferrite core, which, however, is not limitative. Concretely, one preferred embodiment of producing the magnetic cores includes granulating essential ingredients of an oxide that contains at least one element selected from Li, Mg, Ca, Mn, Ni, Cu, Zn and Sr, and $Fe_2O_3$, and sintering the resulting particles.

The coating resin is for protecting the carrier particles from being contaminated with wax and for protecting them from toner adhesion thereto, for which preferred is a resin having high mechanical strength and resistant to abrasion and external shock to break it. Concretely, it includes polyolefin resins, polyvinyl and polyvinylidene resins, acrylic resins, polyacrylonitriles, polyvinyl acetates, polyvinyl alcohols, polyvinyl butyrals, polyvinyl chlorides, polyvinyl carbazoles, polyvinyl ethers, polyvinyl ketones, polyesters, polyurethanes, polycarbonates, amino resins, epoxy resins, vinyl chloride-vinyl acetate copolymers, styrene-acryl copolymers, organosiloxane-bonded silicone resins and their modified derivatives, fluororesins, etc. Especially preferred are resins having low surface energy, such as silicone resins and their modified derivatives, and fluororesins (e.g., perfluorooctylethyl acrylate copolymers, polytetrafluoroethylenes, polyvinyl fluorides, polyvinylidene fluorides, polychlorotrifluoroethylenes, etc.).

Preferably, the carrier particles have a mean particle diameter falling between 25 and 45 $\mu$m, more preferably between 30 and 40 $\mu$m. Having such a defined mean particle diameter of from 25 to 45 $\mu$m, the carrier enables a more uniform thin developer layer (magnetic brush layer) to give images of high quality. If too small, however, the magnetic force of such small carrier particles is low and the small carrier particles will readily transfer onto latent image holding members. As opposed to such small particles, the carrier particles having the suitable mean particle diameter as above are free from the problem with the small particles.

Preferably, the carrier resistance is at least $10^{15}\Omega$ in an electric field of 1 V/$\mu$m and is at most $10^{12}\Omega$ in an electric field of 2 V/$\mu$m for ensuring good image development to give better images with improved gradation. Using the field-dependent carrier all the time enables good image development to give better images with improved gradation. The carrier resistance is in terms of the unit in the lengthwise direction of the developer holding member, and it is measured in the same manner as that mentioned hereinabove for measuring the developer resistance.

In the image-forming method of the invention, the distance between the latent image holding member and the developer holding member may be enlarged whereby the magnetic brush layer before the development nip could be prevented from being influenced by the electric field of the latent image on the latent image holding member, like hereinabove. However, if the distance between the latent image holding member and the developer holding member is too large, the development nip for actual development will be too narrow, or in an extreme case, the magnetic brush layer could not be brought into contact with the latent image holding member. If so, the developability between the two holding members will greatly decrease, and in such an extreme case, development is impossible. In order to enlarge the distance between the latent image holding member and the developer holding member with ensuring a satisfactory development nip, the developer density on the developer holding member will have to be increased. However, too much increasing the developer density thereon is problematic in that the developer will drop off from the developing machine and, when the toner concentration in the developer is varied, the developer supply will often fail. Accordingly, the distance between the latent image holding member and the developer holding member preferably falls between 200 $\mu$m and 900 $\mu$m, more preferably between 300 $\mu$m and 600 $\mu$m.

In the development step in the image-forming method of the invention, it is desirable that a bias voltage that includes alternating components at a frequency, f, of at most 6000 Hz, preferably from 3000 to 5000 Hz is applied between the developer holding member and the latent image holding member to produce toner images. Applying the bias voltage in such an alternating electric field at a frequency, f, of at most 6000 Hz to the two holding members ensures improved developability of the toner while retarding the carrier vibration, and thereby enables more stable image quality of the toner images formed.

In the development step in the image-forming method of the invention, it is desirable that digital latent images written on the latent image holding member and having a line density of at most 350 pixels/inch, preferably from 200 to 300 pixels/inch are developed into toner images. In the preferred embodiment of the step, the latent images written on the latent image holding member, which are not too thin and are defined to have a line density of at most 350 pixels/inches, are developed into toner images. In this, therefore, the latent images being developed are prevented from being disordered and are well developed into high-quality toner images.

The image-forming method of the invention optionally includes, in addition to the development step mentioned above, a step of uniformly charging the surface of the latent image holding member, a step of exposing the surface of the latent image holding member to form a latent image thereon, a step of transferring the toner image having been formed from the latent image onto a recording medium, a step of fixing the toner image on the recording medium, a step of removing the latent image still remaining on the surface of the latent image holding member through de-electrification, and a step of cleaning the surface of the latent image holding member for removing the toner having still remained thereon, and also for removing paper powder, dust and others having adhered thereto. For the development step in the method of the invention, any known apparatus is employable except for the constitution and the condition specifically defined hereinabove.

The charging step is not specifically defined. For this, for example, employable is any per-se known static charger that includes contact static chargers with an electroconductive or semi-electroconductive roll, brush, film, rubber braid or the like, as well as screen corotron chargers and corotron chargers assisted by corona discharging, etc.

The exposing step is not also specifically defined. For this, for example, employable is an ordinary optical system in which the surface of an electrophotographic photoreceptor having a latent image formed thereon is imagewise exposed to semiconductor rays, LED rays, liquid-crystal shutter rays or the like from their light sources, via a polygonal mirror disposed therebetween.

The transferring step is not also specifically defined. For this, for example, employable is a contact transfer unit where a toner image is contacted under pressure with a transfer roll, a transfer belt or the like to thereby transfer it onto a recording medium, or a non-contact transfer unit where a toner image is transferred onto a recording medium by the use of corotron or the like.

Preferably, the transferring step includes a first transferring step and a second transferring step, as being effective for preventing color drift in multi-color images transferred onto a recording medium. In the preferred embodiment, a toner image is first transferred onto an intermediate transfer medium in the first transferring step (this will be hereinafter referred to as "first transfer"), and the image having been transferred onto the intermediate transfer medium is then transferred onto a recording medium in the second transfer step (this will be hereinafter referred to as "second transfer"). In this, toner images of different colors are transferred from the respective image holding members onto the intermediate transfer medium. Therefore, this embodiment is free from the problem of mismatching between the plural image holding members and the recording medium, and, in this, it is easy to prevent image defects such as color drift in the images to be finally formed on the recording medium. Still another advantage with this is that the conveyor unit for the recording medium can be simplified and the latitude in selecting recording media usable therein is broad.

The first transferring step is not specifically defined. For this, for example, employable is any per-se known transfer charger that includes contact transfer chargers with a belt, roll, film, rubber blade or the like, as well as screen corotron transfer chargers and corotron transfer chargers assisted by corona discharging, etc. Of those, preferred are contact transfer chargers as their capabilities of transfer charge compensation are good. Apart from these transfer chargers, also employable are any others such as friction chargers, etc.

The second transferring step is not also specifically defined. Like in the first transferring step, usable are contact transfer chargers with a transfer roll or the like, as well as screen corotron transfer chargers and corotron transfer chargers also in the second transferring step. Of those, preferred are contact transfer chargers, like in the first transferring step. In such a contact transfer charger with a transfer roll, the image-carrying, intermediate transfer medium is firmly pressed against the transfer roll with a recording medium being sandwiched therebetween, whereby the image is well transferred onto the recording medium. In case where the image-carrying, intermediate transfer medium is pressed against the transfer roll at the position to which it has been guided by a guide roll, the toner image is much better transferred from the intermediate transfer medium onto the recording medium.

Regarding its structure, the intermediate transfer medium may be a single-layered or multi-layered one. For example, the multi-layered medium comprises an electroconductive support coated with an elastic layer of rubber, elastomer, resin or the like and at least one overcoat layer. The shape of the intermediate transfer medium is not specifically defined. Various types of intermediate transfer media are employable, from which any desired one is selected depending on its object. For example, preferred are roll-type or belt-type transfer media. For the invention, especially preferred are endless belt-type transfer media, as having the advantages of good multi-layered color image formation with no color drift, good durability in repeated use, and broad latitude in sub-system disposition. Such endless belt-type intermediate transfer media can be produced in any mode of centrifugal molding, spray coating, dip forming, etc. If desired, sheet-type electroconductive films may be seamed into belt-type transfer media.

For the material for the intermediate transfer medium, for example, preferred are polyurethane resins, polyester resins, polystyrene resins, polyolefin resins, polybutadiene resins, polyamide resins, polyimide resins, polyvinyl chloride resins, polyethylene resins, fluororesins and others that contain any of electroconductive carbon particles, metallic powder of tin oxide, indium oxide, black titanate, etc., or electroconductive polymers dispersed therein. Of those, more preferred are polyimide resins that contain carbon particles dispersed therein.

Preferably, the surface volume resistivity of the intermediate transfer medium falls, for example, between $10^8$ and $10^{16}$ Ωcm. If the surface volume resistivity is smaller than $10^8$ Ωcm, the images formed will bleed or swell; but if larger than $10^{16}$ Ωcm, the images formed will fly, and, as the case may be, the intermediate transfer medium will have to be forcedly de-electrified. Anyhow, the surface volume resistivity overstepping the range as above is unfavorable. Preferably, the thickness of the intermediate transfer medium falls, for example, between 50 and 200 μm or so.

The fixing step is not specifically defined. For this, employable is any per-se known fixation unit that includes, for example, hot roll units for fixation, oven units for fixation, etc. In case where the toner in the developer used herein contains wax, the toner images are allowed to have a lot of fixation latitude, and therefore the fixation step does not require fixation oil supply to the images to be fixed therein (this is so-called oilless fixation). In general, in the fixation step, the toner images are fixed with a lubricant liquid being applied thereto. Such a lubricant liquid applied to the toner images is effective for fixation latitude, but is problematic in that it transfers also to the recording medium and makes the image-fixed medium sticky. Still another problem with the lubricant liquid is that an adhesive tape could not be stuck on the image-fixed medium and overwriting the image-fixed medium with oily ink is impossible. These problems are serious to OHP images. In addition, since the lubricant liquid could not remove the roughness of the fixed image surface, and therefore often lowers OHP transparency. In view of these matters, oilless fixation, if possible herein, is advantageous.

The hot roll fixation unit for the fixing step must be so constructed that the outermost surface of the fixation roll therein is formed from a material having low surface energy. This is in order to prevent the toner from transferring onto the fixation roll in the fixation step. Preferably, the material for the outermost surface of the fixation roll is any of fluororesins such as PFA (tetrafluoroethylene-perfluoroalkyl vinyl ether copolymer) or PTFE (polytetrafluoroethylene), or silicone rubber, as being hardly stained or soiled. For enhancing the abrasion resistance and the mechanical strength of the roll, metal oxides and the like may be added to the outermost surface of the roll. Preferably, the thermal fixation roll is elastic. This is because such an elastic roll can well follow the profile of the toner image formed on the recording medium while changing its form, whereby the thermal conduction area between the roll and the toner image-carrying medium is well broadened and the elastic roll can uniformly transmit its heat to the non-fixed toner image surface for ensuring effective thermal fixation of the image on the recording medium.

The optical de-electrification step is not specifically defined, for which, for example, employable are tungsten lamps, LED, etc. Concretely, the light to be applied to the optical de-electrification may be white light from a tungsten lamp or the like, or red light from LED or the like. The light intensity for the optical de-electrification will be so defined that it could be around a few times to 30 times the quantity of light that corresponds to the half-life exposure sensitivity of the electrophotographic photoreceptor used in the image formation process.

The cleaning step is not also specifically defined, for which is usable any known device.

In the image-forming method of the invention, the resistance of the two-component developer to be used is defined high to be at least $10^{13}\Omega$ in an electric field of 2 V/$\mu$m so as to prevent deletions in the images formed. In the method, in addition, either the diameter of the developer holding member to be used or that of the latent image holding member to be used is defined small, or that is, the former is defined to be at most 20 mm and the latter to be at most 40 mm, to thereby prevent edge deletions in the images formed. Accordingly, in the method, the two-component developer having a resistance of at least $10^{13}\Omega$ in an electric field of 2 V/$\mu$m is thus combined with the developer holding member having a diameter of at most 20 mm or with the latent image holding member having a diameter of at most 40 mm, whereby the latent image holding member is protected from being degraded while used. Preferably, in the method, the developer holding member having a diameter of at most 20 mm is combined with the latent image holding member having a diameter of at most 40 mm, thereby more effectively preventing the image defects of edge deletions and other deletions in the images formed.

EXAMPLES

The invention is described in more detail with reference to the following Examples. In these, parts are all by weight. The following Examples are to demonstrate some embodiments of the invention, and are not intended to restrict the scope of the invention.

The properties of the samples prepared and used herein are measured in the manner mentioned below.

Developer Resistance, and Carrier Resistance

The developer resistance and the carrier resistance are measured according to the method mentioned hereinabove.

Kinematic Melt Viscosity of Wax

The kinematic melt viscosity of wax is measured with a kinematic viscometer, Cannon-Fenske Viscometer (from Shibata Kagaku Kikai Kogyo). The viscometer used herein has a capacity for flow time of at least 200 seconds. A molten wax sample to be measured is put into the viscometer, and left in a thermostat at 120° C. for at least 10 minutes. After the wax melt and the viscometer are both stabilized at 120° C. therein, the wax melt (lubricant resin) is sucked up and run down to measure its flow time. From its flow time thus measured, derived is the kinematic melt viscosity of the wax.

Toner Particle Size

A toner sample is dispersed in an aqueous solution containing a dispersion stabilizer therein, and the resulting toner dispersion is analyzed in Coulter Multisizer II (from Nikka Kikai) to measure the toner particle size.

Carrier Particle Diameter

A carrier sample is analyzed by Droplet And Particle Sizer Series 2600c (from Malvern Instruments) to measure the carrier particle diameter.

Image Density

An image outputted on a sheet of full-color copy paper Type J (from Fuji Xerox) is analyzed for the image density by the use of X-Rite 938 (from X-Rite).

Edge Deletions in Images

A solid image adjacent to a non-image area; an image having a solid image area in a half-tone image area; and an image having a half-tone image area in a solid image area are separately outputted. The images are macroscopically analyzed and checked for edge deletions therein at the trail edge of the solid image directly adjacent to the non-image area, and in the boundary at which the image structures change. These are evaluated according to the following criteria:

A: With no image defects seen therein, the images are all good.

B: With some but negligible image defects seen therein, the images are on a practicable level.

C: With many image defects seen therein, the images are unsuitable to practical use.

Other Deletions in Images

An entire solid image is outputted on a sheet of A3-size copy paper, and the number of deletions therein is counted. The image is evaluated according to the following criteria:

A: At most 3 deletions.

B: 4 to 19 deletions.

C: 20 or more deletions.

Gradation, ΔID

An image of 100% image pixels is outputted on a sheet of full-color copy paper Type J (from Fuji Xerox) to have a controlled image density, ID of around 1.6. This is compared with an image of 20% image pixels outputted on the same type of copy paper under the same controlled condition, to obtain the image gradation, ΔD.

Light Transmittance, PE, of Toner Image Fixed on OHP Sheet

A toner image fixed on an OHP sheet is analyzed for light transmittance therethrough by the use of MATCH-SCAN II (from MILTON ROY), and the PE (projection efficiency) value of the toner image is obtained.

<Preparation of Carrier 1>

200 parts of toluene, 30 parts of a copolymer of perfluorooctylethyl acrylate and methyl methacrylate (monomer ratio, 15/85; weight-average molecular weight, 50,000; number-average molecular weight, 25,000) and 2.7 parts of carbon black (Vulcan XC72, from Cabot) are mixed to prepare a coating resin solution. This is milled in a sand mill for 20 minutes. The coating resin solution is put into a vacuum degassing kneader along with 1000 parts of Cu—Zn ferrite particles having a mean particle size of 36 μm, and these are stirred under heat at 80° C. for 10 minutes in the closed kneader. With degassing the kneader, these are further stirred therein and the solvent is removed. After the solvent is thus removed, the resulting mixture is sieved through a 105 μm mesh sieve to remove the aggregated solid from it. Thus is prepared Carrier 1.

<Preparation of Carrier 2>

Like Carrier 1, Carrier 2 is prepared in the same manner as above, for which, however, used is 1000 parts of ferrite having a mean particle size of 27 μm.

<Preparation of Carrier 3>

Like Carrier 1, Carrier 3 is prepared in the same manner as above, for which, however, used is 1000 parts of ferrite having a mean particle size of 44 μm.

<Preparation of Carrier 4>

Like Carrier 1, Carrier 4 is prepared in the same manner as above, for which, however, used is 4 parts of carbon black.

<Preparation of Carrier 5>

Like Carrier 1, Carrier 5 is prepared in the same manner as above, for which, however, used is 5 parts of carbon black.

<Preparation of Carrier 6>

Like Carrier 1, Carrier 6 is prepared in the same manner as above, for which, however, used are 35 parts of the perfluorooctylethyl acrylate-methyl methacrylate copolymer and 1.5 parts of carbon black.

<Preparation of Carrier 7>

150 parts of toluene, 25 parts of a copolymer of perfluorooctylethyl acrylate and methyl methacrylate (monomer ratio, 15/85; weight-average molecular weight, 50,000; number-average molecular weight, 25,000) and 2 parts of carbon black (Vulcan XC72, from Cabot) are mixed to prepare a coating resin solution. This is milled in a sand mill for 20 minutes. The coating resin solution is put into a vacuum degas sing kneader along with 1000 parts of Cu—Zn ferrite particles having a mean particle size of 38 μm, and these are stirred under heat at 80° C. for 10 minutes in the closed kneader. With degassing the kneader, these are further stirred therein and the solvent is removed. After the solvent is thus removed, the resulting mixture is sieved through a 105 μm mesh sieve to remove the aggregated solid from it. Thus is prepared Carrier 7.

<Preparation of Carrier 8>

Like Carrier 7, Carrier 8 is prepared in the same manner as above, for which, however, used is 1000 parts of ferrite having a mean particle size of 29 μm.

<Preparation of Carrier 9>

Like Carrier 7, Carrier 9 is prepared in the same manner as above, for which, however, used is 1000 parts of ferrite having a mean particle size of 43 μm.

<Preparation of Carrier 10>

Like Carrier 7, Carrier 10 is prepared in the same manner as above, for which, however, used is 3 parts of carbon black.

<Preparation of Carrier 11>

Like Carrier 7, Carrier 11 is prepared in the same manner as above, for which, however, used is 4 parts of carbon black.

<Preparation of Toner 1>

Composition

| | |
|---|---|
| Polyester (linear polyester obtained from terephthalic acid, bisphenol A-ethylene oxide adduct, and glycerin; Tg = 73° C.; Mn = 3200; Mw = 28000; acid value = 13; hydroxyl value = 28; chloroform-insoluble content = 0; melt viscosity at 100° C. = $1.9 \times 10^5$ PaS) | 85 parts |
| C.I. Pigment Blue 15:3 | 3 parts |
| Carnauba wax (melting point 81° C.; kinematic melt viscosity $5 \times 10^{-5}$ $m^2$/sec (50 cSt)) | 7 parts |
| Fumed silica (particle size 12 nm; processed with hexamethylene-disilazane) | 5 parts |

These ingredients are pre-mixed, and then kneaded in an extruder. The resulting slab is rolled, cooled, ground, and powdered in a jet mill. The resulting powder is classified in an air classifier to remove coarse particles and fine particles. Thus is obtained a classified powder having a volume-average particle size of 7.3 μm. To 100 parts of the classified powder, added are 1 part of silane coupling agent-processed rutile-type titania (mean primary particle size 20 nm) and 1 part of silicone oil-processed silica (mean primary particle size 42 nm), and stirre in a Henschel mixer. The resulting mixture is sieved through a 45 μm mesh sieve to remove coarse particles. Thus is prepared Toner 1.

<Preparation of Toner 2>

Like Toner 1, Toner 2 having a volume-average particle size of 7.6 μm is prepared in the same manner as above, for which, however, used are 90 parts of the linear polyester, 3 parts of C.I. Pigment Blue 15:3 and 7 parts of carnauba wax.

<Preparation of Toner 3>

Composition

| | |
|---|---|
| Polyester (linear polyester obtained from terephthalic acid, bisphenol A-ethylene oxide adduct, and glycerin; Tg = 71° C.; Mn = 3000; Mw = 25000; acid value = 12; hydroxyl value = 30; chloroform-insoluble content = 0; melt viscosity at 100° C. = $1.7 \times 10^5$ PaS) | 92 parts |
| C.I. Pigment Blue 15:3 | 3 parts |
| Carnauba wax (melting point 81° C.; kinematic melt viscosity $5 \times 10^{-5}$ $m^2$/sec (50 cSt)) | 5 parts |

These ingredients are pre-mixed, and then kneaded in an extruder. The resulting slab is rolled, cooled, ground, and powdered in a jet mill. The resulting powder is classified in an air classifier to remove coarse particles and fine particles. Thus is obtained a classified powder having a volume-average particle size of 7.8 μm. To 100 parts of the classified powder, added are 0.7 parts of silane coupling agent-processed silica (mean primary particle size 12 nm) and 1 part of silicone oil-processed silica (mean primary particle size 42 nm), and stirre in a Henschel mixer. The resulting mixture is sieved through a 45 μm mesh sieve to remove coarse particles. Thus is prepared Toner 3.

<Preparation of Toner 4>

Like Toner 3, Toner 4 having a volume-average particle size of 5.8 μm is prepared in the same manner as above.

<Preparation of Toner 5>

Like Toner 3, Toner 5 is prepared in the same manner as above, for which, however, used is polyethylene wax (melting point 120° C.; kinematic melt viscosity $3.8 \times 10^{-4}$ $m^2$/sec (380 cSt)) and not carnauba wax.

<Preparation of Developer Holding Member 1>

The surface of a stainless pipe having a diameter of 18 mm is blasted with spherical glass beads in a pneumablaster (from Fuji Seisakusho), and a cylindrical magnet having a magnetic flux density of 1220 gausses, 5 magnetic poles and having a diameter of 14 mm is fitted into the-thus blasted pipe to prepare Developer Holding Member 1.

<Preparation of Developer Holding Member 2>

The surface of a stainless pipe having a diameter of 15 mm is blasted with spherical glass beads in a pneumablaster (from Fuji Seisakusho), and a cylindrical magnet having a magnetic flux density of 1990 gausses, 5 magnetic poles and having a diameter of 12 mm is fitted into the-thus blasted pipe to prepare Developer Holding Member 2.

<Preparation of Developer Holding Member 3>

The surface of a stainless pipe having a diameter of 25 mm is blasted with spherical glass beads in a pneumablaster (from Fuji Seisakusho), and a cylindrical magnet having a magnetic flux density of 1270 gausses, 5 magnetic poles and having a diameter of 21 mm is fitted into the-thus blasted pipe to prepare Developer Holding Member 3.

<Preparation of Latent Image Holding Member 1>

Composition

| | |
|---|---|
| Acetylacetonezirconium butoxide (Orgatics ZC540 from Matsumoto Kosho) | 22 parts |
| γ-aminopropyltriethoxysilane (A1100 from Nippon Uniquer) | 3 parts |
| Polyvinyl butyral resin (Eslec BM-S from Sekisui Chemical) | 1.8 parts |
| N-butyl Alcohol | 80 parts |

An aluminium pipe having a diameter of 30 mm is dipped in a solution having the composition as above, and dries at 150° C. for 15 minutes to form thereon a subbing layer having a thickness of 0.8 μm.

Composition

| | |
|---|---|
| X-type metal-free phthalocyanine | 4.5 parts |
| Vinyl chloride-vinyl acetate copolymer (VMCH from Union Carbide) | 6 parts |
| N-butyl acetate | 200 parts |

These ingredients are milled in a sand mill filled with 1 mmϕ glass beads for 1 hour to prepare a dispersion. This is applied onto the subbing layer-coated aluminium pipe by dipping the pipe in the dispersion, and dries at 120° C. for 10 minutes to form a charge-generating layer having a thickness of 0.3 μm on the subbing layer.

Composition

| | |
|---|---|
| Triarylamine compound (oxidation potential, Eox = 0.78) | 1 part |
| Polycarbonate | 1 part |
| Monochlorobenzene | 6 parts |

The thus-coated aluminium pipe is dipped in a solution having the composition as above, and dries at 135° C. for 1 hour to form thereon a charge-transporting layer having a thickness of 20 μm.

In the manner as above, prepared is Latent linage Holding Member 1.

<Preparation of Latent Image Holding Member 2>

Like Latent Image Holding Member 1, Latent Image Holding Member 2 is prepared in the same manner as above, for which, however, an aluminium pipe having a diameter of 38 mm is coated with the layers.

<Preparation of Latent Image Holding Member 3>

Like Latent Image Support 1, Latent Image Support 3 is prepared in the same manner as above, for which, however, an aluminium pipe having a diameter of 50 mm is coated with the layers.

EXAMPLES 1 TO 7

Comparative Examples 1 and 2

As in Table 1 below, the carriers, toners and developer holding members are tested for image formation in a modified image-forming apparatus of Fuji Xerox's Acolor 635 (fitted with a latent image holding member having a diameter of 48 mm).

The apparatus is modified as follows: The original fixation roll is replaced with a PFA-tubed silicone rubber roll, and the fixation oil supplier is removed. The developing unit is reformed. Concretely, the inner magnet is fixed to the developer holding member so that the stainless pipe of the holding member could rotate via a gear; and the magnetic brush regulator is so controlled that the developer supply rate could be 400±50 g/m$^2$. For the image formation test, the distance between the latent image holding member and the developer holding member is 0.4 mm; the contrast potential is −250 V; the alternating electric field for bias voltage is 1.6 kvpp; the frequency for bias voltage is 6500 Hz; the bias voltage duty is 55%; the process speed is 120 mm/sec; and the speed ratio of the developer holding member and the latent image holding member is 2.

For image quality evaluation, the images formed are checked for deletions including edge deletions therein and for the gradation ΔID. The test results are given in Table 1.

TABLE 1

| | Carrier | Toner | Developer Holding Member | Developer Resistance (2 V/μm) | Carrier Resistance (1 V/μm) | Carrier Resistance (2 V/μm) | Edge Deletions | Other Deletions | ΔID |
|---|---|---|---|---|---|---|---|---|---|
| Example 1 | Carrier 1 | Toner 1 | Developer Holding Member 1 | $10^{15.1}$ Ω | $10^{15.5}$ Ω | $10^{11.1}$ Ω | A | A | 1.3 |
| Example 2 | Carrier 2 | Toner 1 | Developer Holding Member 1 | $10^{15.7}$ Ω | $10^{16}$ Ω | $10^{11.8}$ Ω | A | A | 1.2 |

TABLE 1-continued

| | Carrier | Toner | Developer Holding Member | Developer Resistance (2 V/μm) | Carrier Resistance (1 V/μm) | Carrier Resistance (2 V/μm) | Edge Deletions | Other Deletions | ΔID |
|---|---|---|---|---|---|---|---|---|---|
| Example 3 | Carrier 3 | Toner 1 | Developer Holding Member 1 | $10^{14.8}$ Ω | $10^{15.2}$ Ω | $10^{10.9}$ Ω | A | A | 1.2 |
| Example 4 | Carrier 4 | Toner 1 | Developer Holding Member 1 | $10^{13.9}$ Ω | $10^{13.1}$ Ω | $10^{10.2}$ Ω | A | B | 0.9 |
| Example 5 | Carrier 6 | Toner 1 | Developer Holding Member 1 | $10^{16.3}$ Ω | $10^{16.8}$ Ω | $10^{14.7}$ Ω | B | A | 0.7 |
| Example 6 | Carrier 1 | Toner 1 | Developer Holding Member 2 | $10^{15.3}$ Ω | $10^{15.6}$ Ω | $10^{11.1}$ Ω | A | A | 1.3 |
| Example 7 | Carrier 1 | Toner 2 | Developer Holding Member 1 | $10^{14.9}$ Ω | $10^{15.5}$ Ω | $10^{11.1}$ Ω | A | B | 1.2 |
| Comp. Ex. 1 | Carrier 5 | Toner 1 | Developer Holding Member 1 | $10^{11.0}$ Ω | $10^{12.1}$ Ω | $10^{9.1}$ Ω | A | C | 1.1 |
| Comp. Ex. 2 | Carrier 1 | Toner 1 | Developer Holding Member 3 | $10^{14.8}$ Ω | $10^{15.2}$ Ω | $10^{10.9}$ Ω | C | B | 1.2 |

Free from edge deletions and other deletions therein and having good gradation, the images formed in Examples 1, 2, 3 and 6 are all good. In the images formed in Example 5, some trail edge deletions are seen therein but are negligible in practical use. The images are flat as having somewhat low gradation. In the images formed in Examples 4 and 7, some deletions are seen therein but are negligible in practical use. In Example 7, a small amount of wax in the toner used bleeds out in the extruder, and staines the unit. In addition, while the toner is ground, it significantly adheres to the inner wall of the unit. As the ground toner contains many aggregates, the amount of the coarse particles increases when the toner is classified. In Comparative Example 1, the images formed have many deletions therein; and in Comparative Example 2, the images formed have noticeable edge deletions therein. The image quality of the images formed in these Comparative Examples is poor.

EXAMPLES 8 TO 14

Comparative Examples 3 and 4

As in Table 2 below, the carriers, toners and latent image holding members are tested for image formation in a modified image-forming apparatus of Fuji Xerox's Acolor 635 (fitted with a developer support having a diameter of 30 mm).

The apparatus is modified as follows: The original fixation roll is replaced with a PFA-tubed silicone rubber roll, and the fixation oil supplier is removed. The latent image-fitting mechanism is so reformed that any latent image holding member having a varying diameter could be fitted thereto. For this, however, the distance between the latent image holding member and the developer holding member and the angle of the developing machine are not varied irrespective of the diameter of the latent image holding member used. For the image formation test, the magnetic brush density of the developer on the developer holding member is 40 mg/cm$^2$; the distance between the latent image holding member and the developer holding member is 0.4 mm; the contrast potential is −300 V; the alternating electric field for bias voltage is 1.4 kvpp; the frequency for bias voltage is 5500 Hz; the bias voltage duty is 50%; the process speed is 100 mm/sec; and the speed ratio of the developer holding member and the latent image holding member is 1.8. On the latent image holding member, written is a digital latent image of 300 pixels/inch.

For image quality evaluation, the images formed are checked for edge deletions and other deletions therein and for the PE value. The test results are given in Table 2.

TABLE 2

| | Carrier | Toner | Latent Image Holding Member | Developer Resistance (2 V/μm) | Edge Deletions | Other Deletions | PE |
|---|---|---|---|---|---|---|---|
| Example 7 | Carrier 7 | Toner 3 | Latent Image Holding Member 1 | $10^{15.1}$ Ω | A | A | 84 |
| Example 8 | Carrier 8 | Toner 3 | Latent Image Holding Member 1 | $10^{14.3}$ Ω | B | A | 83 |
| Example 9 | Carrier 9 | Toner 3 | Latent Image Holding Member 1 | $10^{15.8}$ Ω | B | A | 85 |
| Example 10 | Carrier 10 | Toner 3 | Latent Image Holding Member 1 | $10^{13.2}$ Ω | A | A | 84 |
| Example 11 | Carrier 7 | Toner 4 | Latent Image Holding Member 1 | $10^{15.3}$ Ω | A | B | 82 |
| Example 12 | Carrier 7 | Toner 5 | Latent Image Holding Member 1 | $10^{14.9}$ Ω | A | A | 77 |
| Example 13 | Carrier 7 | Toner 3 | Latent Image Holding Member 2 | $10^{15.1}$ Ω | A | A | 84 |
| Comp. Ex. 3 | Carrier 11 | Toner 3 | Latent Image Holding Member 1 | $10^{11.9}$ Ω | A | C | 81 |
| Comp. Ex. 4 | Carrier 7 | Toner 3 | Latent Image Holding Member 3 | $10^{15.2}$ Ω | C | A | 83 |

Free from edge deletions and other deletions therein and having good transparency in OHP, the images formed in Examples 8, 11 and 14 are all good. In the images formed in Examples 9 and 10, some edge deletions are seen therein but are negligible in practical use. In the images formed in Example 12, some deletions are seen therein. The image quality of the images is somewhat inferior to that of the images in the other Examples. The images formed in Example 13 are free from edge deletions and other deletions therein, but are somewhat dull owing to poor coloration. The OHP transparency of the images is not so good. In Comparative Example 3, the images formed have many deletions therein; and in Comparative Example 4, the images formed have noticeable edge deletions therein. The image quality of the images formed in these Comparative Examples is poor.

EXAMPLE 15

The carrier, the toner, the developer holding member and the latent image holding member shown in Table 3 below are tested for image formation in the same manner as in Example 1. The test results are given in Table 3.

TABLE 3

| | Carrier | Toner | Developer Holding Member | Latent Image Holding Member | Developer Resistance (2 V/μm) | Carrier Resistance (1 V/μm) | Carrier Resistance (2 V/μm) | Edge Deletions | Other Deletions | ΔID |
|---|---|---|---|---|---|---|---|---|---|---|
| Example 15 | Carrier 1 | Toner 1 | Developer Holding Member 1 | Latent Image Holding Member 1 | $10^{15.1}$ Ω | $10^{15.5}$ Ω | $10^{11.1}$ Ω | A | A | 1.3 |

Free from edge deletions and other deletions therein, the images formed in Examples 15 are all good. In addition, the images formed have good gradation and therefore had good image quality.

According to the invention described hereinabove with reference to its embodiments, there is provided a method for image formation capable of stably outputting high-quality images with no image density unevenness for a long period of time, in which the images formed are free from image defects of so-called deletions including edge deletions therein and which ensures good and uniform developability everywhere in the latent image region to be developed with preventing the latent image support used from being degraded.

While the invention has been described in detail and with reference to specific embodiments thereof, it will be apparent to one skilled in the art that various changes and modifications can be made therein without departing from the spirit and scope thereof.

What is claimed is:

1. A method for forming a color image, comprising the steps of:

forming a latent image on a latent image holding member;

developing the latent image on the latent image holding member with a two-component developer on a developer holding member disposed to face the latent image holding member; and transferring the developed toner image onto a transfer medium, wherein the developer holding member is a cylindrical sleeve having a diameter of at most 20 mm, the two-component developer comprises a carrier and a toner, and a developer resistance is at least $10^{13}$Ω in an electric field of 2 V/μm.

2. The method for forming a color image as claimed in claim 1, wherein the developer holding member is a cylindrical sleeve having a diameter from 10 to 20 mm.

3. The method for forming a color image as claimed in claim 1, wherein the developer holding member comprises a magnetic field-generating unit therein, and the magnetic force from the unit is at least 0.1 T (1000 gausses).

4. The method for forming a color image as claimed in claim 1, wherein the resistance of the two-component developer falls between $10^{13}$ and $10^{16}$Ω in an electric field of 2 V/μm.

5. The method for forming a color image as claimed in claim 1, wherein the toner coverage of the carrier in the two-component developer falls between 13 and 70%.

6. The method for forming a color image as claimed in claim 1, wherein the toner contains a binder resin, wax and a colorant.

7. The method for forming a color image as claimed in claim 6, wherein the wax has a kinematic melt viscosity of at most $3\times10^{-4}$ $m^2$/sec (300 cSt) at 120° C.

8. The method for forming a color image as claimed in claim 1, wherein the carrier has a mean particle diameter falling between 25 and 45 μm.

9. The method for forming a color image as claimed in claim 1, wherein the resistance of the carrier is at least $10^{15}$Ω in an electric field of 1 V/μm and at least $10^{12}$Ω in an electric field of 2 V/μm.

10. The method for forming a color image as claimed in claim 1, wherein the transferring step comprises a first transferring step of transferring the toner image onto an intermediate transfer medium and a second transferring step of transferring the toner image from the intermediate transfer medium onto an image holding member, and the surface volume resistivity of the intermediate transfer medium falls between $10^8$ and $10^{16}$ Ωcm.

11. The method for forming a color image as claimed in claim 1, wherein the latent image holding member is a cylindrical sleeve having a diameter of at most 40 mm.

12. A method for forming a color image, comprising the steps of:

forming a latent image on a latent image holding member;

developing the latent image on the latent image holding member with a two-component developer on a developer holding member disposed to face the latent image holding member; and transferring the developed toner image onto a transfer medium, wherein the latent image holding member is a cylindrical sleeve having a diameter of at most 40 mm, and the resistance of the two-component developer is at least $10^{13}$Ω in an electric field of 2 V/μm.

13. The method for forming a color image as claimed in claim 12, wherein the latent image holding member is a cylindrical sleeve having a diameter from 18 to 40 mm.

14. The method for forming a color image as claimed in claim 12, wherein the diameter of the developer holding member falls between 10 mm and 35 mm.

15. The method for forming a color image as claimed in claim 12, wherein the resistance of the two-component developer falls between $10^{13}$ and $10^{16}$Ω in an electric field of 2 V/μm.

16. The method for forming a color image as claimed in claim 12, wherein the toner coverage of the carrier in the two-component developer falls between 13 and 70%.

17. The method for forming a color image as claimed in claim 12, wherein the toner contains a binder resin, wax and a colorant.

18. The method for forming a color image as claimed in claim 17, wherein the wax has a kinematic melt viscosity of at most $3\times10^{-4}$ $m^2$/sec (300 cSt) at 120° C.

19. The method for forming a color image as claimed in claim 12, wherein the toner further contains fine inorganic particles therein.

20. The method for forming a color image as claimed in claim 12, wherein the resistance of the carrier is at least $10^{15}\Omega$ in an electric field of 1 V/$\mu$m and at least $10^{12}\Omega$ in an electric field of 2 V/$\mu$m.

* * * * *